US011149207B2

(12) United States Patent
Kottakuna et al.

(10) Patent No.: US 11,149,207 B2
(45) Date of Patent: Oct. 19, 2021

(54) DELAYED COKING FURNACE FOR HEATING COKER FEEDSTOCK

(71) Applicant: Indian Oil Corporation Limited, Mumbai (IN)

(72) Inventors: Arjun Kumar Kottakuna, Haryana (IN); Ponoly Ramachandran Pradeep, Haryana (IN); Terapalli Hari Venkata Devi Prasad, Haryana (IN); Satyen Kumar Das, Haryana (IN); Madhusudan Sau, Haryana (IN); Debasis Bhattacharyya, Haryana (IN); Sanjiv Kumar Mazumdar, Haryana (IN); Sankara Sri Venkata Ramakumar, Haryana (IN)

(73) Assignee: Indian Oil Corporation Limited, Mumbai (IN)

( * ) Notice: Subject to any disclaimer, the term of this patent is extended or adjusted under 35 U.S.C. 154(b) by 0 days.

(21) Appl. No.: 16/899,176

(22) Filed: Jun. 11, 2020

(65) Prior Publication Data

US 2020/0392414 A1 Dec. 17, 2020

(30) Foreign Application Priority Data

Jun. 12, 2019 (IN) ..... 201921023334

(51) Int. Cl.

| | |
|---|---|
| ***C10G 9/20*** | (2006.01) |
| ***C10B 55/00*** | (2006.01) |
| ***C10G 9/00*** | (2006.01) |

(52) U.S. Cl.

CPC ..... *C10G 9/20* (2013.01); *C10B 55/00* (2013.01); *C10G 9/005* (2013.01)

(58) Field of Classification Search

CPC ..... C10G 9/005; C10G 9/18–206

See application file for complete search history.

(56) References Cited

U.S. PATENT DOCUMENTS

| | | | | |
|---|---|---|---|---|
| 6,264,798 | B1 | 7/2001 | Gibson et al. | |
| 6,626,663 | B1 | 9/2003 | Zhu | |
| 2014/0127091 | A1* | 5/2014 | Wang | F28F 1/40 422/198 |

FOREIGN PATENT DOCUMENTS

| | | | | |
|---|---|---|---|---|
| CN | 202152332 | * | 2/2012 | C10G 9/20 |
| CN | 101982524 | * | 5/2013 | C10G 9/20 |
| CN | 205011706 | * | 2/2016 | C10G 9/20 |

OTHER PUBLICATIONS

English machine translation of CN 205011706, obtained from Google Patents. (Year: 2016).*

(Continued)

*Primary Examiner* — Renee Robinson

(74) *Attorney, Agent, or Firm* — Blank Rome LLP

(57) ABSTRACT

A delayed coking furnace (100) for heating coker feedstock (101) is disclosed. The furnace (100) includes a first heating zone (102) adapted to provide heat to the coker feedstock (101) through a convective heat transfer and then a second heating zone (104) positioned below the first heating zone (102) and adapted to heat the coker feedstock (101) through radiative heat transfer, wherein the second heating zone (104) include a lower portion and an upper portion. Further, said furnace (100) includes a plurality of burners (106) located at the lower portion of the second heating zone (104) and at least one baffle (111) disposed in the upper portion of the second heating zone (104). Further, the present disclosure provides that the at least one baffle (111) is adapted to increase a convective heat transfer coefficient associated with a flue gas flowing from the second heating zone (104) to the first heating zone (102).

9 Claims, 3 Drawing Sheets

(56) References Cited

OTHER PUBLICATIONS

English machine translation of CN 202152332, obtained from Google Patents. (Year: 2012).*
English machine translation of CN 101982524, obtained from Google Patents. (Year: 2013).*

* cited by examiner

DELAYED COKING FURNACE FOR HEATING COKER FEEDSTOCK

RELATED APPLICATION

This application claims the benefit of Indian Application No. 201921023334, filed on Jun. 12, 2019. The entire disclosure of this application is hereby incorporated by reference.

FIELD OF THE INVENTION

The present disclosure generally relates to heating furnaces and more particularly, relates to a delayed coking furnace for heating coker feedstock.

BACKGROUND OF THE INVENTION

As is generally known, delayed coking process is a heating process in which vacuum residue (residue from Vacuum Distillation Unit) is subjected to severe thermal cracking when the necessary heat is supplied by a heating furnace. Therefore, a coker furnace is considered as the heart of a Delayed Coking unit. It is the most critical hardware element in the furnace as a sudden outage of the furnace will lead to the shutdown of the whole unit.

Accordingly, continuous efforts are being made to improve the delayed coking process and in the last few decades, significant growth and development have been witnessed in said process in terms of achieving uniform heat flux in the furnace. Also, feedstock like vacuum residue is highly prone to coking inside the coils due to the presence of the high asphaltene content as well as other high molecular weight compounds. Coking inside the coils increases the pressure drop affecting the heat transfer between the flue gas and process fluid which further necessitates more heat requirement. Therefore, heat flux inside the radiation section is to be properly designed and monitored to prevent the aforesaid phenomenon from occurring.

U.S. Pat. No. 6,626,663B1 discloses about applying coating on radiation tubes having different emissivity and thermal conductivity. By virtue of varying emissivity and thermal conductivity along the tubes, uniform heat flux can be obtained. However, due to the application of coatings with varying emissivity characteristics, heat absorbed by the process fluid will not be uniform along the tubes. Further, high heat absorption rates in tubes of low emissivity coatings are susceptible to sudden phase change which may result in the precipitation of the asphaltene and other high molecular weight compounds. This may eventually lead to coking formation inside the tubing.

Further, U.S. Pat. No. 6,264,798B1 discloses a furnace scheme wherein a double row of tubes are utilized in a double-fired furnace. The spacing between the double rows tubes will facilitate additional surface area for entry of cold flue gas creating recirculation of gas which eventually helps in uniform heat flux. However, the addition of the second row of tubes results in the reduction of the effective area exposed. Further, the additional row of tubes demands more heating requirements to meet the thermal profile same as the single row tubes. As a result, the localized peak heat flux tends to increase at some points leading to the coke formation inside the coils.

Additionally, furnace run length also plays a critical role in the sustainable operation of the delayed coking unit. Shorter run lengths lead to an unscheduled shutdown of the unit which affects the profitability of the whole refinery.

High localized heat flux, poor burner design, improper monitoring of air to fuel ratio, etc. are few reasons for the aforesaid phenomenon. Although many efforts are underway to improve the performance of the furnace, enhancement of furnace run length remained a challenge. An improved heat flux distribution inside the delayed coker furnace can improve the run length and it is desired to have a furnace design that can achieve better control of the localized heat flux.

SUMMARY OF THE INVENTION

This summary is provided to introduce a selection of concepts in a simplified format that is further described in the detailed description of the present disclosure. This summary is not intended to identify key or essential inventive concepts of the present disclosure, nor is it intended for determining the scope of the present disclosure.

In an embodiment of the present disclosure, a coking furnace for heating coker feedstock is disclosed. The furnace includes a first heating zone adapted to provide heat to the coker feedstock through a convective heat transfer and then a second heating zone positioned below the first heating zone and adapted to heat the coker feedstock through radiative heat transfer, wherein the second heating zone include a lower portion and an upper portion. Further, said furnace includes a plurality of burners located at the lower portion of the second heating zone and at least one baffle disposed of in the upper portion of the second heating zone. Further, the present disclosure provides that the at least one baffle is adapted to increase a convective heat transfer coefficient associated with a flue gas flowing from the second heating zone to the first heating zone.

In an embodiment of the present disclosure, it is provided that the tube metallurgy is maintained same in all the tubes of the second heating zone. Further, the furnace with the at least one baffle is disposed to control the heat flux and the controlled heat flux further helps in increasing furnace overall life-time. Also, it has been disclosed that the single row of tubes disposed between the double rows of burners helps in facilitating better control of maximum to average heat flux ratio.

To further clarify advantages and features of the present disclosure, a more particular description of the disclosure will be rendered by reference to specific embodiments thereof, which is illustrated in the appended drawings. It is appreciated that these drawings depict only typical embodiments of the disclosure and are therefore not to be considered limiting of its scope. The disclosure will be described and explained with additional specificity and detail with the accompanying drawings.

BRIEF DESCRIPTION OF DRAWINGS

To further clarify advantages and features of the present disclosure, a more particular description of the disclosure will be rendered by reference to specific embodiments thereof, which is illustrated in the appended drawing. It is appreciated that these drawings depict only typical embodiments of the disclosure and are therefore not to be considered limiting its scope. The disclosure will be described and explained with additional specificity and detail with the accompanying drawings in which.

Figure 1:
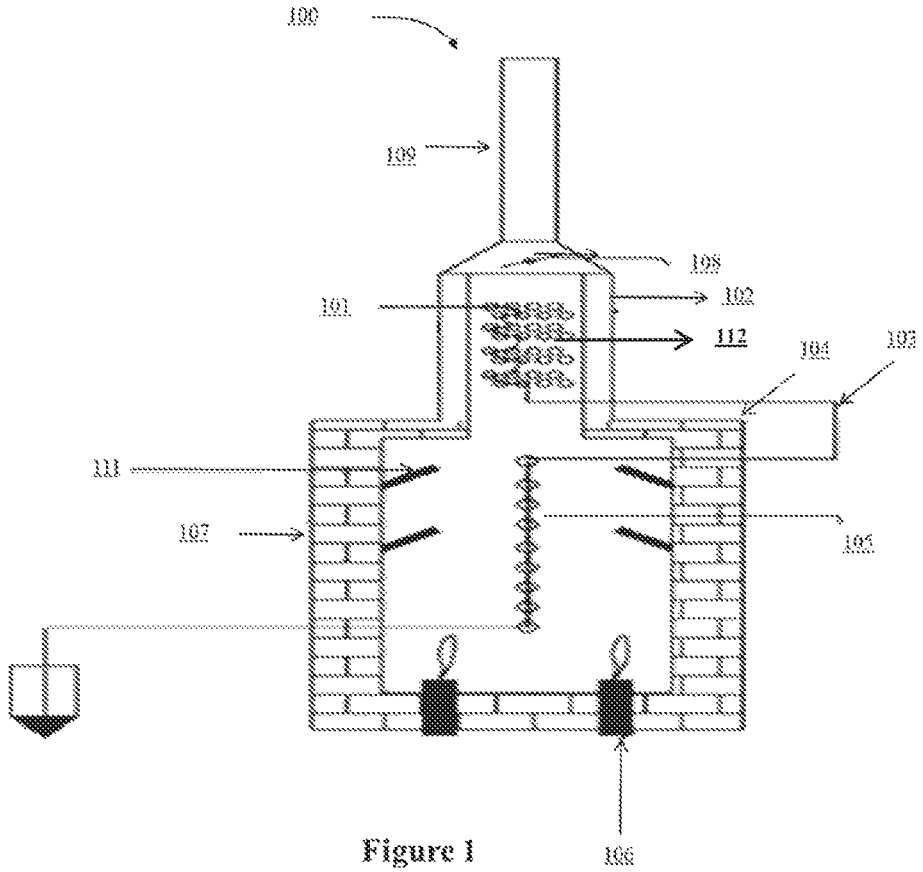
FIG. 1 illustrates a schematic view of a delayed coking furnace for heating coker feedstock, in accordance with an embodiment of the present disclosure.

Further, skilled artisans will appreciate that elements in the drawings are illustrated for simplicity and may not have necessarily been drawn to scale. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION

For the purpose of promoting an understanding of the principles of the invention, reference will now be made to the embodiment illustrated in the drawings, and specific language will be used to describe the same. It will nevertheless be understood that no limitation of the scope of the invention is thereby intended. Such alterations and further modifications in the illustrated system, and such further applications of the principles of the invention as illustrated therein would be contemplated as would normally occur to one skilled in the art to which the invention relates. Unless otherwise defined, all technical and scientific terms used herein have the same meaning as commonly understood by one of ordinary skilled in the art. The system, methods, and examples provided herein are illustrative only and are not intended to be limiting.

The term "some" as used herein is to be understood as "none or one or more than one or all." Accordingly, the terms "none," "one," "more than one," "more than one, but not all" or "all" would all fall under the definition of "some." The term "some embodiments" may refer to no embodiments or to one embodiment or to several embodiments or to all embodiments, without departing from the scope of the present disclosure.

The terminology and structure employed herein is for describing, teaching, and illuminating some embodiments and their specific features. It does not in any way limit, restrict or reduce the spirit and scope of the claims or their equivalents.

More specifically, any terms used herein such as but not limited to "includes," "comprises," "has," "consists," and grammatical variants thereof do not specify an exact limitation or restriction and certainly do not exclude the possible addition of one or more features or elements, unless otherwise stated, and furthermore must not be taken to exclude the possible removal of one or more of the listed features and elements, unless otherwise stated with the limiting language "must comprise" or "needs to include."

Whether or not a certain feature or element was limited to being used only once, either way, it may still be referred to as "one or more features" or "one or more elements" or "at least one feature" or "at least one element." Furthermore, the use of the terms "one or more" or "at least one" feature or element do not preclude there being none of that feature or element, unless otherwise specified by limiting language such as "there needs to be one or more . . . " or "one or more element is required."

Unless otherwise defined, all terms, and especially any technical and/or scientific terms, used herein may be taken to have the same meaning as commonly understood by one having ordinary skills in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Use of the phrases and/or terms including, but not limited to, "a first embodiment," "a further embodiment," "an alternate embodiment," "one embodiment," "an embodiment," "multiple embodiments," "some embodiments," "other embodiments," "further embodiment", "furthermore embodiment", "additional embodiment" or variants thereof do not necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should not be necessarily taken as limiting factors to the attached claims. The attached claims and their legal equivalents can be realized in the context of embodiments other than the ones used as illustrative examples in the description below.

Embodiments of the present invention will be described below in detail with reference to the accompanying drawings.

The present disclosure provides a thermal cracking furnace 100 for a residue feedstock 101. The present disclosure takes perforated baffles 111 and other parameters into consideration for facilitating better control of maximum to average heat flux ratio. By doing so, the furnace 100 as disclosed in the present disclosure achieves a uniform heat flux in the second heating zone 104 which helps in the enhancement of the furnace run lengths. Further, the present disclosure also facilitates effective and controlled low-pressure drops inside the delayed coking furnace 100.

FIG. 1 illustrates a schematic view of a delayed coking furnace for heating coker feedstock, in accordance with an embodiment of the present disclosure. In an embodiment of the present disclosure, the delayed coking heating furnace 100 may interchangeably be referred to as the delayed heating furnace 100. The delayed heating furnace 100 may include, but is not limited to, a first heating zone 102 and a second heating zone 104 disposed below the first heating zone 102. The first heating zone 102 is adapted to provide heat to the coker feedstock 101 through convective heat transfer. The second heating zone 104 is adapted to heat the coker feedstock 101 through radiative heat transfer. Further, the second heating zone 104 includes a lower portion and an upper portion. Initially, the pre-heated coker feedstock 101, hereinafter referred to as the feedstock 101, is charged to the first heating zone 102 of the delayed heating furnace 100. In the first heating zone 102, the feedstock 101 is heated at a temperature in a range of 380-430° C. by a flue gas emitting from the second heating zone 104, Further, around 20-40% of the heat is absorbed by the feedstock 101 generated from the flue gas in the first heating zone 102.

In an embodiment, the delayed heating furnace 100 may include at least one tube 112 disposed in the first heating zone 102. The delayed heating furnace 100 may further include a plurality of tubes 112 configured to be arranged in a plurality of rows. At least one tube 112 is adapted to be of fin-type for improved heat transfer from the flue gases, i.e., the hot flue gases, to the feedstock 101. However, the tubes 112 are arranged in a first row and a row consecutive to the first row and are disposed at a bottom of the first heating zone 102. Such tubes may be referred to as bare tubes i.e. without fins or studs and they are also known as the shield section or the shock tubes.

The tubes further act as a shield to protect the first heating zone 102 tubes from direct radiation from the second heating zone 104.

In an embodiment, the heated feedstock 101 from the first heating zone 102 is sent to the second heating zone 104 through a crossover tube 103. The crossover tube 103 is adapted to connect the first heating zone 102 and the second heating zone 104. In the second heating zone 104, a plurality of tubes 105 is adapted to be arranged horizontally with respect to the second heating zone 104 to absorb around 60-80% of the total heat emitting from the flue gas. The plurality of heating tubes 105 is in fluid communication with the crossover tube 103. Also, a refractory lining 107 is adapted to be placed inside the furnace 100 which helps in the prevention of heat loss to the surroundings. However, around 1-3% of total heat loss will be unavoidable even after the refractory lining 107 inside the furnace 100. In an embodiment, the refractory lining 107 may be positioned inside the furnace 100 surrounding the second heating zone 104. Fuel and air are continuously combusted with the help of a plurality of burners 106 adapted to be located at the lower portion of the second heating zone 104. Generally, 10-25% excess air is supplied for gaseous fuels and 15-30% excess air is supplied for liquid fuels to ensure the complete combustion of the fuel. The temperature of the flue gas gradually decreases while exchanging the heat with both the first heating zone 102 and the second heating zone 104, and then finally released to the atmosphere with the help of a stack 109.

In an embodiment, a damper 108 may be disposed above the first heating zone 102 to regulate a pressure difference inside the delayed coking furnace 100. It should be noted that very high pressure inside the delayed coking furnace 100 is susceptible to leakage of the flue gases. While on the other hand, if the pressure inside the furnace 100 is low, it enables the ambient air to enter the delayed coking furnace 100. Therefore, the careful monitoring of the pressure difference inside the delayed coking furnace 100 is required.

In an embodiment of the present disclosure, the furnace 100 as claimed in the present disclosure is adapted to handle the coker feedstock 101 upto 35 wt % conradson carbon residue (CCR). In an embodiment, the feedstock 101 is charged to the first heating zone 102 and the coker feedstock 101 is heated in a range of 380-420° C. based on a specification of the feedstock 101.

In yet another embodiment of the present disclosure, a plurality of tubes 105 is adapted to be placed horizontally in the second heating zone 104 between the double rows of burners 106. Further, at least a plurality of perforated baffles 111 is adapted to be installed in the upper portion of the second heating zone 104. Also, the at least a plurality of perforated baffles 111 is adapted to be installed at equal distance. The at least a plurality of baffles 111 is configured to increase the convective heat transfer coefficients of the flue gas flowing from the second heating zone 104 to the first heating zone 102. The baffles 111 are provided to facilitate higher heat transfer between source, i.e., flue gas, and the feedstock 101 flowing in a coil disposed in the second heating zone 104. As a result, the amount of fuel required is also reduced which further helps in the reduction of intensity of peak heat flux zones in the second heating zone 104. Moreover, localized hotspots can be avoided which in turn reduces the coking inside the coil. This further helps to achieve an extended furnace lifetime also known as the furnace run lengths. Also, the reduced coking helps to achieve a low-pressure drop inside the furnace 100.

Figure 2A:
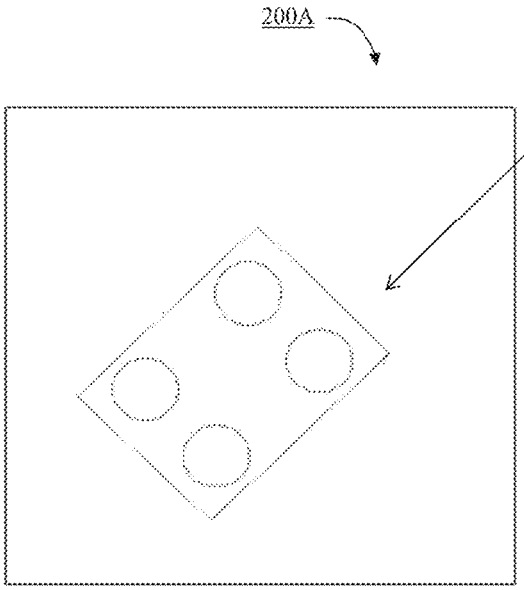
FIG. 2A illustrates a schematic view of perforated baffles of the delayed coking furnace for heating coker feedstock, in accordance with an embodiment of the present disclosure.
Figure 2B:
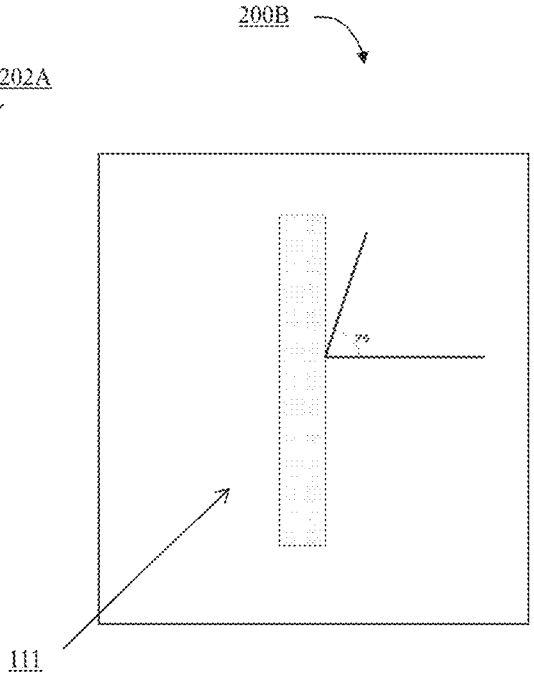
FIG. 2B illustrates the orientation of the perforated baffles, in accordance with an embodiment of the present disclosure.

FIG. 2A illustrates a schematic view of perforated baffles of the delayed coking furnace for heating coker feedstock, in accordance with an embodiment of the present disclosure. FIG. 2B illustrates the orientation of the perforated baffles, in accordance with an embodiment of the present disclosure. In order to avoid duplicity of information, the description of FIG. 2A and FIG. 2B are explained in conjunction with each other. As depicted in the figures, the baffles 111 can be oriented at 0 to 85 degrees from the horizontal plane in the upward and downward directions. Further, the baffles can be oriented from 5 to 90 degrees from the vertical plane in either direction. The orientation of the baffles 111 depends on the scope available for enhancing the heat transfer in the furnace 100. The at least one baffle 111 is perforated 202A. Further, the total number of perforations and the diameter of the same may be decided based on the desired pressure drop across the furnace using well-established methods that are already prevalent to the person skilled in the art. A number of the at least one baffle 111 is in a range of 1 to 6. In an embodiment of the present invention, a shape of the at least one baffle 111 may be in the form of a square, a rectangle, etc.

Figure 3A:
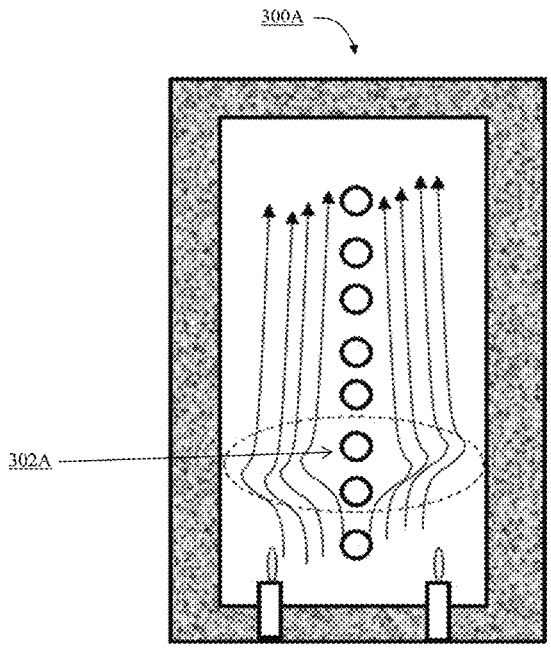
Figure 3A (Prior Art)
FIG. 3A illustrates a schematic view of the conventional delayed coking heating furnace depicting a flow of heat flux, according to an embodiment of the present disclosure.
Figure 3B:
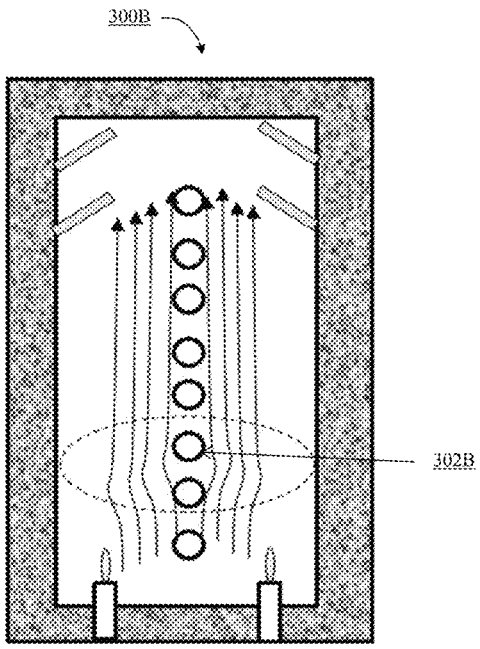
FIG. 3B illustrates a schematic view of the delayed coking furnace depicting a flow of heat flux, according to an embodiment of the present disclosure.

FIG. 3A illustrates a schematic view of the conventional delayed coking heating furnace depicting a flow of heat flux, according to an embodiment of the present disclosure. FIG. 3B illustrates a schematic view of the delayed coking furnace depicting a flow of heat flux, according to an embodiment of the present disclosure. In order to avoid duplicity of information, the description of FIG. 3A and FIG. 3B are explained in conjunction with each other. In the conventional furnace, peak heat flux 302A is generally observed in the bottom portion of the second heating zone. With the incorporation of baffles 111 as depicted in FIG. 3B of the present disclosure, the intensity of the peak heat flux 302B points is reduced due to the lower fuel requirement as compared to the conventional furnace. As a result, the present disclosure aims to achieve better heat flux distribution inside the second heating zone 104.

Therefore, the incorporation of the at least one baffle 111, in the delayed coking furnace 100, results in an increased convection heat transfer coefficient. This further leads to better heat transfer between the flue gas and the coker feedstock 101. Further, fuel requirement is also reduced to achieve the same Coil Outlet Temperature (COT). As explained above, an overall uniform heat flux in the second heating zone 104 of the furnace 100 further helps in the enhancement of furnace run length (furnace life-time). It is further advantageous that the usage of the baffles 111 in the furnace 100 helps to mitigate the coke lay-down across the peak heat flux zones. Hence, the overall efficiency of the delayed coking furnace 100 is increased and the high amount of fuel savings can be obtained. This further helps in a significant reduction in emissions of pollutant gases due to low fuel burning. Therefore, the thermal cracking furnace 100 of the present disclosure is easy to design, flexible, accurate, compact, and ensures better handling of the residue feedstock 101.

The figures and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of the embodiments is by no means limited by these specific examples. Numerous variations, whether explicitly given in the specification or not, such as differences in structure, dimension, and use of material, are possible. The scope of the embodiments is at least as broad as given by the following claims.

We claim:

1. A delayed coking furnace for heating coker feedstock, the delayed coking furnace comprising:

a first heating zone adapted to provide heat to the coker feedstock through convective heat transfer;

a second heating zone positioned below the first heating zone and adapted to heat the coker feedstock through radiative heat transfer, wherein the second heating zone includes a lower portion and an upper portion;

a plurality of burners located at the lower portion of the second heating zone; and a plurality of perforated baffles installed in the upper portion of the second heating zone, wherein the plurality of perforated baffles are installed at equal distance from each other, and wherein the plurality of perforated baffles are adapted to increase a convective heat transfer coefficient associated with a flue gas flowing from the second heating zone to the first heating zone.

2. The furnace as claimed in claim 1, wherein the coker feedstock is heated in a range of 380-420° C. by the flue gas flowing from the second heating zone.

3. The furnace as claimed in claim 1, wherein the furnace is configured to handle the coker feedstock up to 35 wt % Conradson Carbon Residue (CCR).

4. The furnace as claimed in claim 1, further comprising a crossover tube disposed between the first heating zone and the second heating zone and adapted to transfer the coker feedstock from the first heating zone to the second heating zone.

5. The furnace as claimed in claim 4, further comprising a plurality of heating tubes horizontally positioned in the second heating zone and in fluid communication with the crossover tube.

6. The furnace as claimed in claim 1, wherein at least one tube in the first heating zone is adapted to be of fin-type to enhance the heat transfer between a flue gas and the coker feedstock.

7. The furnace as claimed in claim 1, wherein the plurality of perforated baffles are configured to be oriented between 0 to 85 degrees from a horizontal plane in either direction.

8. The furnace as claimed in claim 1, wherein the plurality of perforated baffles are configured to be oriented between 5 to 90 degrees from a vertical plane in either direction.

9. The furnace as claimed in claim 1, wherein a damper is disposed above the first heating zone to regulate a pressure difference inside the furnace.

* * * * *